US005371933A

United States Patent [19]

Godfrey

[11] Patent Number: 5,371,933

[45] Date of Patent: Dec. 13, 1994

[54] FASTENER SETTING TOOL WITH OFFSET NOSE ASSEMBLY

[75] Inventor: Bruce T. Godfrey, Royal Oak, Mich.

[73] Assignee: GBP Corporation, Warren, Mich.

[21] Appl. No.: 223,110

[22] Filed: Apr. 5, 1994

[51] Int. Cl.[5] ..... B21J 15/10; B21J 15/20

[52] U.S. Cl. ..... 29/243.529; 29/243.522; 72/391.8

[58] Field of Search ..... 29/243.521, 243.522, 29/243.529; 72/391.2, 391.4, 391.8

[56] References Cited

U.S. PATENT DOCUMENTS 3,475,945 11/1969 Chirco ..... 29/243.522
3,713,321 1/1973 La Pointe ..... 72/391
4,796,455 1/1989 Rosier ..... 72/391
4,813,261 3/1989 Rosier ..... 29/243.522
5,208,959 5/1993 Rosier et al. ..... 72/391.2

*Primary Examiner*—David Jones
*Attorney, Agent, or Firm*—Krass & Young

[57] ABSTRACT

A fastener setting tool including an anvil housing having an offset anvil portion and a collet positioned slidably in the anvil housing and including an offset portion coacting with the offset anvil portion of the anvil housing to defined an offset nose assembly. The tool further includes a cylinder housing secured to the anvil housing and defining a central bore slidably receiving a piston. A draw bar interconnects the collet and the piston with the collet and piston maintained in a precise and rigid position on the draw bar utilizing a reduced diameter threaded portion on one end of the draw bar coacting with a nut threaded onto the reduced diameter threaded portion and engaging an outboard end of the piston.

9 Claims, 3 Drawing Sheets

FIG-5
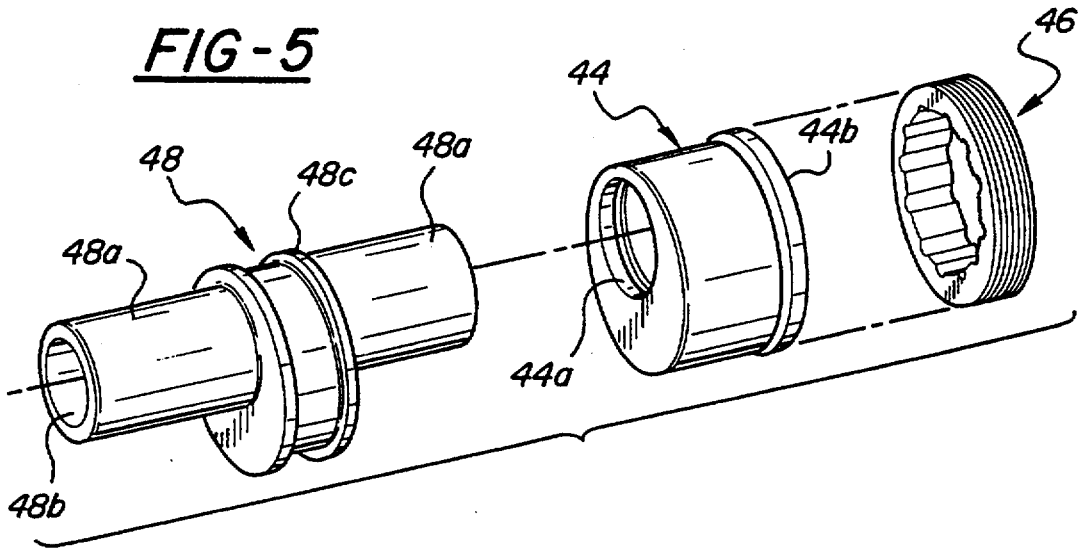
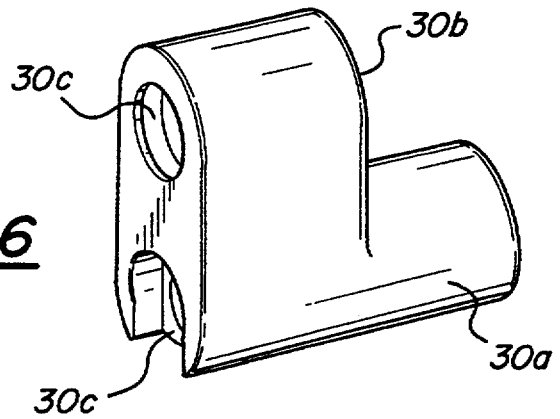
FIG-6
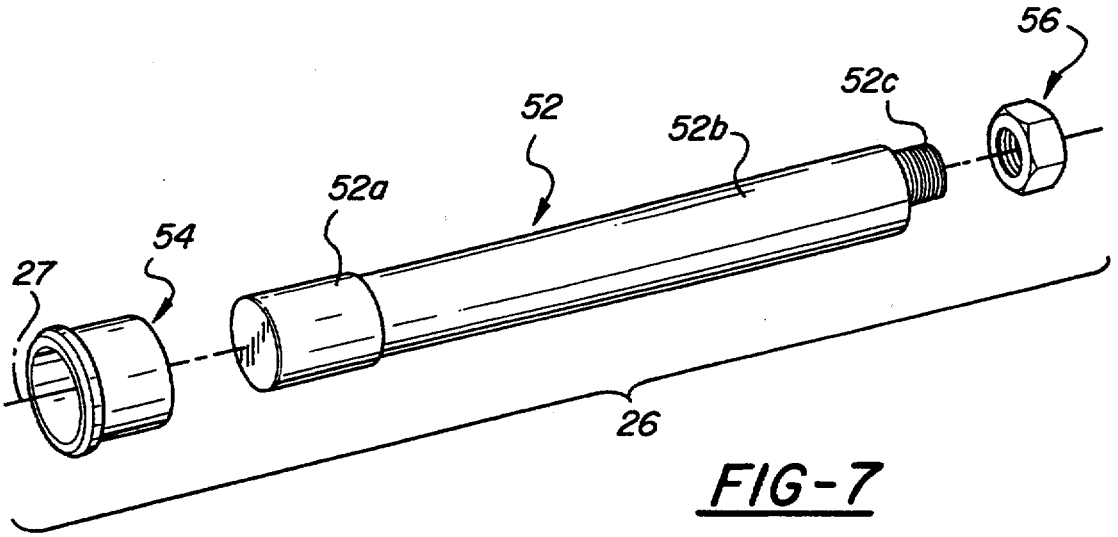
FIG-7

FASTENER SETTING TOOL WITH OFFSET NOSE ASSEMBLY

BACKGROUND OF THE INVENTION

This invention relates to fastener setting tools and more particularly to fastener setting tools having offset nose assemblies.

Fastener tools having offset nose assemblies are required to provide access to fasteners located between closely spaced panels or within small clearance spaces. The offset nose assembly may include, for example, an anvil and a collet for swaging a fastener collar about a grooved fastener pin. In such designs the swaging anvil is radially offset from the axis of the piston which drives the anvil against the collet. This arrangement allows the radially offset anvil portion of the nose assembly to access the fasteners without interference from the anvil housing and/or from tile main body of the tool.

By offsetting the axis of the fastener pin and collar assembly from the primary power axis of the tool, large bending forces are generated at the nose assembly during swaging of the collar around the pin. These bending forces tend to generate deflection between the anvil and collet as well as deflection of the entire nose assembly with respect to the body Of the tool and with respect to the pin and collet. This deflection can cause binding of the collet within the anvil housing and can cause premature or uncontrolled pin breakage.

Various attempts have been made to address these deflection problems but all of the prior art attempts to address this problem have suffered from one or more disadvantages. Specifically, the prior art devices have attempted to prevent the deflection forces by the use of bulky, massive components, thereby detracting from the portability of the tool and thereby limiting the ability of the tool to access small spaces; and/or the prior art devices have attempted to prevent the deflection forces by utilizing threaded connections which are difficult if not impossible to precisely control in a mass production environment.

SUMMARY OF THE INVENTION

This invention is directed to the provision of an improved fastener setting tool having an offset nose assembly.

More specifically, this invention is directed to the provision of an offset nose assembly fastener tool which may be readily and inexpensively constructed and which effectively prevents the generation of excessive deflection forces at the offset nose assembly.

The invention fastener setting tool is of the type including a collet having inboard and outboard ends, an anvil housing mounting the collet for sliding movement along a central axis of the anvil housing and defining an anvil offset from the central axis and coacting with an offset portion of the collet to define an offset nose assembly, a piston having all inboard and positioned proximate the inboard end of the collet and an outboard end, a cylinder housing connected to the anvil housing and mounting the piston for sliding movement in the cylinder housing along a central axis, and a draw bar having a first portion positioned in a bore in the collet and a second portion positioned in a bore in the piston and operative to rigidly interconnect the collet and the piston so that the collet and piston may stroke as a unit within the anvil and cylinder housings along the central axis.

According to the invention, the outboard end of the second draw bar portion is threaded and a nut is threaded onto the draw bar threaded portion and clampingly engages the outboard end of the piston. This arrangement eliminates the necessity of a precise threaded interconnection as between the draw bar and the piston and thereby eliminates the deflection and cocking problems inherent in the threaded interconnection. This arrangement further allows the draw bar and piston to be coupled together without drawing the collet away from the anvil.

According to a further feature of the invention, the cylinder housing includes an outboard end wall; the outboard end of the piston passes through an opening in the end wall; and the diameter of the nut is less than the diameter of the opening so that the nut may move into the end wall opening during the stroking movement of the collet and piston assembly. This arrangement provides a compact, efficient assembly and allows the invention thread and nut arrangement to be utilized in a standard fastener setting tool environment.

According to a further feature of the invention, the draw bar threaded portion comprises a reduced diameter threaded portion. This arrangement allows the nut to be drawn up against the end wall of the draw bar to provide a precise positioning of the nut with respect to the draw bar.

According to a further feature of the invention the cylinder housing defines an annular flange outboard of the outboard end wall in surrounding relation to the opening. This arrangement defines a recess at the outboard end of the cylinder housing to shield the outboard end of the piston and the nut.

BRIEF DESCRIPTION OF THE DRAWINGS

FIG. 5 is an exploded perspective view showing several of the internal components of the fastener setting tool;

FIG. 6 is a perspective view showing a collet utilized in the invention fastener setting tool; and FIG. 7 is an exploded perspective view showing a drawbar assembly utilized in the invention fastener setting tool.

DETAILED DESCRIPTION OF THE PREFERRED EMBODIMENT

Figure 1:
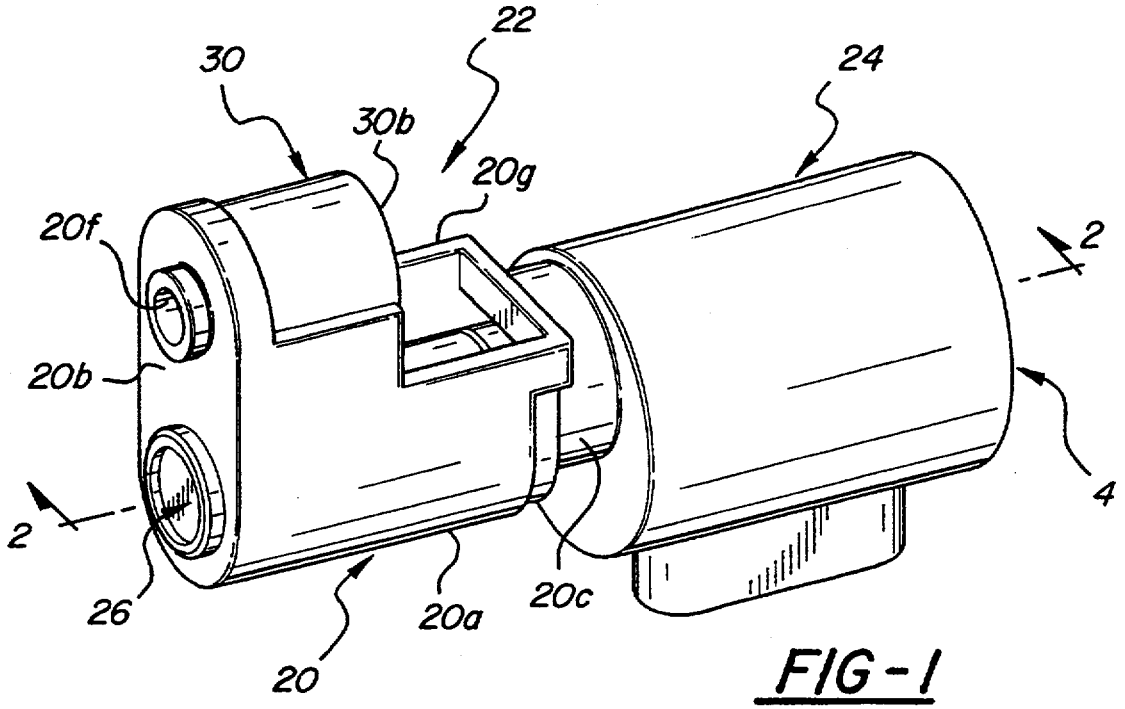
FIG. 1 is a perspective view of a fastener setting tool according to the invention.
Figure 3:
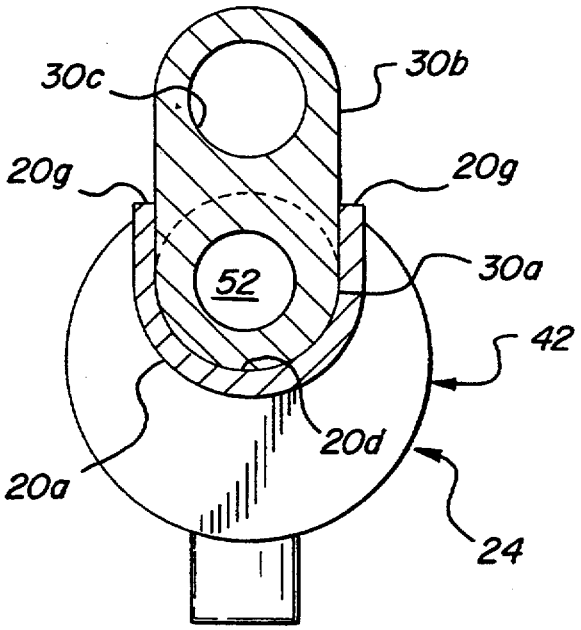
FIG. 3 is a cross sectional view taken on line 3—3 of FIG. 2.
Figure 4:
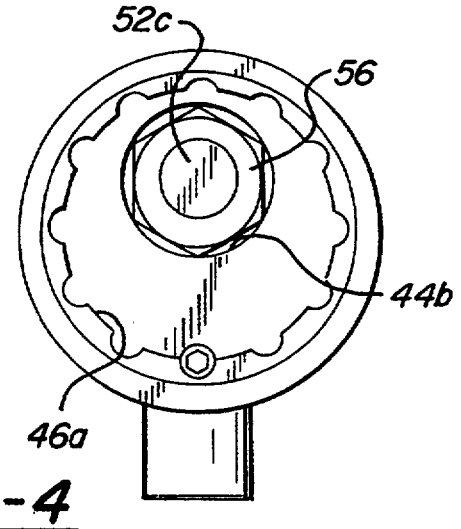
FIG. 4 is an end view looking in the direction of the arrow 4 in FIG. 2.
Figure 2:
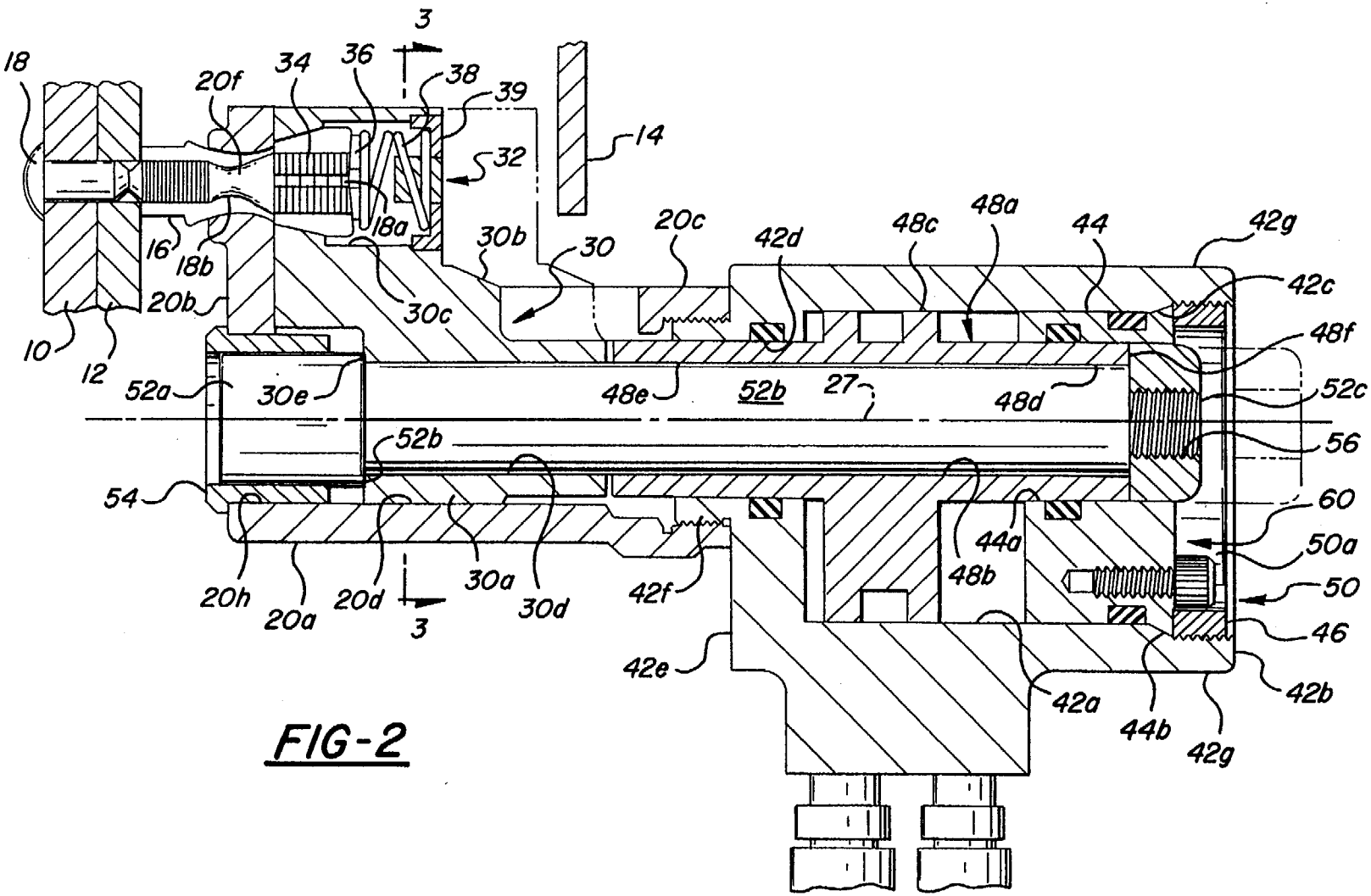
FIG. 2 is a cross sectional view taken on line 2—2 of FIG. 1.

In overview, the invention fastener setting tool, by virtue of its offset nose assembly construction, is intended to reach into confined spaces, as defined for example between abutting panel members 10 and 12 and a closely adjacent panel member 14, to swag a collar 16 about a grooved connector pin 18 passing through aligned openings in the abutting panels 10 and 12 and thereby fixedly secure the panels 10 and 12 together by the coaction of pin 18 and collar 16.

The invention fastener setting tool, broadly considered, includes an anvil housing 20, a collet assembly 22, a cylinder assembly 24, and a draw bar assembly 26.

Anvil housing 20 includes a main body housing 20a, an anvil portion 20b and a connector portion 20c. Anvil main body portion 20a defines a U-shaped slideway 20d centered on a central longitudinal axis 27. Anvil portion 20b is offset from central axis 27 and defines an opening 20f for passage of a pin 18.

Collet assembly 22 includes a collet 30 and a gripper assembly 32.

Collet 30 includes a main body portion 30a sized to be slidably received in slideway 20d for sliding movement along central axis 27 and an offset portion 30b offset from central axis 27 and coacting with the anvil portion 20b of the anvil housing to define an offset nose assembly. Collet main body portion 30a defines a central bore 30d centered on axis 27.

Gripper assembly 32 is received in a bore 30c in the offset portion 30b of collet 30 and includes a chuck jaw set 34, a follower 36, a spring 38, and an end cap 39 closing the rear end of bore 30c and mounting the rear end of spring 38. Gripper assembly 32 acts in known manner to grip the free end or pintail portion 18a of a connector pin 18 inserted through anvil opening 20f to facilitate the swaging of the collar 16 about the grooved shaft of the pin and to thereafter break off the pintail portion of the pin at a weakened reduced diameter section 18b.

Cylinder assembly 24 includes a cylinder housing 42, a cylinder end cap 44, a retainer ring 46, and a piston 48.

Cylinder housing 42 has a generally circular cylindrical configuration and defines a cylindrical bore 42a opening in the rear face 42b of the cylinder housing.

Cylinder end cap 44 has a cylindrical configuration, is fitted slidably and sealingly in the rear end of bore 42a, and includes a through bore 44a and a beveled rim portion 44b. Through bore 44a is offset from the central axis of the end cap. Rim portion 44b seats against a beveled annular shoulder 42c defined by the cylinder housing to determine and delimit the inserted position of the end cap within the bore 42a.

Retainer ring 46 is threadably received in the open end of bore 42a and includes a scalloped inner periphery 46a so that the retainer ring may be held in its fully inserted position against rim 44b of end cap 44 by a screw 50 threaded into the end cap and having its head portion 50a positioned in a respective scallop in the scalloped surface 46a to lock the retainer ring in its fully inserted position and thereby maintain end cap 44 in a positively locked position within bore 42a so as to positively close the rear end of bore 42a.

Piston 48 is sized to be slidably received in bore 42a and includes a main body tubular portion 48a defining a central bore or passage 48b and offset cylindrical sealing ringportions 48c sized to slidably and sealingly engage the surface of cylinder housing bore 42a.

Draw bar assembly 26 includes a draw bar 52, a bushing 54, and a nut 56.

Draw bar 52 includes an enlarged head portion 52a at the forward end of the draw bar, a central main body portion 52b, and a reduced diameter threaded portion 52c at the rear end of the draw bar.

Nut 56 has a diameter generally corresponding to the diameter of piston main body portion 48a and slightly less than the diameter of end cap opening 44b. The thickness of nut 56 corresponds generally to the length of reduced diameter draw bar threaded portion 56c.

In the assembled relation of the fastener setting tool, piston 48 is slidably received in bore 42a with the rearward or outboard end 48d of the piston slidably received in the bore 44a of cylinder end cap 44 and the forward or inboard end 48e of the piston slidably received in an opening 42d in the front end wall 42e of the cylinder housing; anvil housing 20 is fixedly secured to cylinder housing 42 by the threaded interconnection of anvil housing connector portion 20c on an externally threaded hub portion 42f of the cylinder housing; collet 30 is slidably received in anvil housing with the main body portion 30a of the collet slidably received in the slideway 20d of the anvil housing and the collet offset portion 30b positioned slidably between spaced side wall 20g of the anvil housing and coacting with the anvil portion 20b of the anvil housing to define the offset nose assembly; bushing 54 is received in an opening 20a in the anvil housing concentric with central axis 37: and draw bar 52 is received within the aligned central bores 30d of collet 30 and 48b of piston 48 with enlarged head portion 52a fitted slidably in bushing 54 and defining an annular shoulder 52b seating against an annular shoulder 30e defined by the collet in surrounding relation to central bore 30d and with nut 56 threaded onto reduced diameter threaded portion 52c for abutting engagement with the annular rear or outboard face 48f of the piston.

Nut 56 and shoulder 30e will be seen to coact to firmly clamp the collet and the piston together on the draw bar to form a rigid unitary piston and collet assembly for reciprocal joint movement during the operation of the tool to perform the swaging operations in response to the introduction in known manner of pressurized fluid into bore 42a. It will further be seen that cylinder housing 42 includes an annular rear flange portion 42g which defines a recess 60 to nestingly and protectively receive the nut 56 and the reduced diameter threaded portion 52c of the draw bar. It will further be seen that, since the nut 56 has a diameter less than the diameter of the central opening 44b of end cap 44, the nut may move nestingly within the opening 44b during the actuation of the tool and may occupy a nested position within the opening 44b when the tool is at rest.

The invention will be seen to provide many important advantages as compared to prior art fastener setting tools. Specifically, the reduced diameter threaded end portion of the draw bar in coaction with the nut serve to effectively lock the piston and collet together for joint reciprocal movement during the actuation of the device without requiring precision control of coacting threads interconnecting the draw bar and the piston and/or collet. As a practical matter, the invention enables the draw bar to be fitted with a smooth tight tolerance within a smooth bore of the piston so as to substantially preclude cocking of the draw bar relative to the piston and thereby substantially preclude cocking of the offset nose assembly during tool actuation. The invention also allows for the exact positioning of the collet in relation to the anvil and, specifically, allows assembly of the collet, anvil and drawbar without causing the collet to draw away from the anvil. It will be understood that drawing away of the collet from the anvil as encountered in prior art designs involving direct threaded interengagement as between the draw bar and the piston causes problems in pull-in applications and also with respect to the ejection of the collet from the anvil after pin breakage.

Whereas a preferred embodiment of the invention has been illustrated and described and detail it will be obvious that various changes may be made in the disclosed embodiment without departing from the scope or spirit of the invention.

I claim:

1. A fastener setting tool including a collet having inboard and outboard ends, an anvil housing mounting the collet for sliding movement along a central axis of the anvil housing an defining an anvil offset from the central axis and coacting with an offset portion of the collet to define an offset nose assembly, a piston having an inboard end positioned proximate the inboard end of the collet and an outboard end, a cylinder housing connected to the anvil housing and mounting the piston for sliding movement in a cylinder housing bore along the central axis, and a draw bar having a first portion positioned in a bore in the collet and a second portion positioned in a bore in the piston and operative to rigidly interconnect the collet and the piston so that the collet and piston may stroke as a unit within the anvil and cylinder housings along the central axis; characterized in that:

the outboard end of the second draw bar portion is threaded; and a nut is threaded onto the draw bar threaded portion and clampingly engages the outboard end of the piston.

2. A fastener setting tool according to claim 1 wherein:

the cylinder housing includes an outboard end wall;

the outboard end of the piston passes through an opening in the end wall; and the diameter of the nut is less than the diameter of the opening so that the nut may move into the end wall opening during the stroking movement of the collet and piston assembly.

3. A fastener setting tool according to claim 1 wherein:

the draw bar threaded portion comprises a reduced diameter threaded portion.

4. A fastener setting tool according to claim 3 wherein:

the cylinder housing includes an outboard end wall;

the outboard end of the piston passes through an opening in the end wall; and the diameter of the nut is less than the diameter of the opening so that the nut may move into the end wall opening during stroking movement of the collet and piston.

5. A fastener setting tool according to claim 4 wherein:

the cylinder housing defines an annular flange outboard of the outboard end wall in surrounding relation to the opening whereby to define a recess to shield the outboard end of the piston and the nut.

6. A fastener setting tool according to claim 1 wherein:

an annular shoulder is defined on the draw bar approximate the outboard end of the first draw bar portion; and the outboard end of the collet is clamped against the annular shoulder in response to the clamping action of the nut against the outboard end of the piston.

7. A fastener setting tool according to claim 6 wherein:

the outboard end of the first draw bar portion comprises an enlarged head portion; and the annular shoulder is defined at the juncture of the enlarged head portion and the main body of the draw bar.

8. A fastener setting tool including:

a cylinder housing defining a bore;

a piston mounted for sliding movement in the cylinder bore along a central axis;

a collet having a main body portion and a radially offset portion;

an anvil housing secured to the cylinder housing, mounting the collet for sliding movement along the central axis, and having a radially offset portion defining an anvil coacting with the offset portion of the collet to define an offset nose assembly;

a draw bar passing through the main body portion of the collet and through the piston and including a threaded portion at the end thereof remote from the nose assembly; and a nut threaded on the draw bar threaded portion and clampingly engaging the end of the piston remote from the nose assembly.

9. A fastener setting tool according to claim 8 wherein:

the remote end of the piston passes through an opening in the end wall of the cylinder housing; and the nut has a diameter less than the diameter of the opening so that the nut may move into the end wall opening during stroking movement of the piston and collet.

* * * * *